United States Patent [19]

Kronogård et al.

[11] Patent Number: 4,678,193

[45] Date of Patent: Jul. 7, 1987

[54] GOLF SWING TRAINING DEVICE

[76] Inventors: Håkan Kronogård, Skarpskyttevägen 26 d, 222 42 Lund; Roberto Selberg, Kilian Zollsgatan 28 a, 217 56 Malmö, both of Sweden

[21] Appl. No.: 711,802

[22] Filed: Mar. 11, 1985

[51] Int. Cl.[4] ..... A63B 69/36

[52] U.S. Cl. ..... 273/186 C; 273/35 A; 273/191 R

[58] Field of Search ..... 273/191 R, 192, 35 A, 273/186 R, 186 C, 191 A, 191 B

[56] References Cited

U.S. PATENT DOCUMENTS

| | | | |
|---|---|---|---|
| 3,132,865 | 5/1964 | Parker | 273/192 |
| 3,460,837 | 8/1969 | Cassa | 273/191 R X |
| 3,482,838 | 12/1969 | Gibson et al. | 273/191 R X |
| 3,934,874 | 1/1976 | Henderson | 273/35 A |
| 4,437,669 | 3/1984 | Pelz | 273/192 X |

*Primary Examiner*—George J. Marlo
*Attorney, Agent, or Firm*—Ladas & Parry

[57] ABSTRACT

Swing starter (1) comprising a straight target rod (2) and a curved rod (3)interconnected by a web (4). The curved rod has a radius of curvature of about 1.55 m and a length of about 0.6 m. The front portion (5) comprises a convex mirror (6) having a indicator line (7) parallel with the target line. The swing starter is placed on the ground having a pin (9) thereof extending down into the ground. The pin allows the swing starter to be pivoted under friction around an axis parallel to the target line. The golfer places himself beside the swing starter opposite the front end (5) thereof. The swing starter is pivoted until a convex mirror (6) positioned at the front end of the curved rod indicates the correct swing plane has been achieved by viewing the shoulder portion of the golfer at a line (7) of the mirror. The upper surface of the curved rod may be provided with a color, e.g., red, differing from the color, e.g. white, of the remaining portion of the device. In an alternate embodiment, the curved rod may be clipped onto and supported by the shaft of a golf club which is positioned on the golfing surface and serves as the target rod.

10 Claims, 5 Drawing Figures

GOLF SWING TRAINING DEVICE

This is a continuation of International Application No. PCT/SE84/00260 filed on July 12, 1984 which designated the United States.

The present invention relates to a device for training golf.

One of the most difficult moments in learning golf is how to move the club in order to achieve an efficient swing.

The ball trajectory is essentially controlled by five factors at the moment the club impacts the ball, viz. (1) the movement direction of the golf club head; (2) the speed of the club head; (3) the position of the club head; (4) the angle of the club head; (5) which point of the club head that impacts the ball.

In order that the golf club head should have the right properties at the moment of impact, it is important how the golf club is moved before the impact but also after.

In the normal case it is assumed that the impact of the ball should be squarely from the side and at the centrum of the ball in order to obtain a straight trajectory for the ball. The club head should move parallel to the ground and tangentially to the target line at the moment of impact.

At such a normal swing the club head moves in a swing circle comprised in a swing plane, which essentially is defined by two points, viz. the golf ball and a rotational centrum close to the shoulder portion of the golfer, and the target line, i.e. the tangent of the swing circle at the bottom point. The tangent should be aligned with the target line and the swing plane should be parallel with the target line.

At the start of a swing, the club head is placed behind the golf ball and the club head is moved backwards and upwards to the upper position and back in order to impact the ball. Such a movement has often a tendency to be too upright or vertical which results in the club head passing along an outside-in path prior to impact with the ball, i.e. the tangent of the swing circle is not parallel with the target line. Such a movement usually imparts a spin to the ball causing a slice and an inefficient trajectory.

There are several devices for training the swing described in the literature. In the French patent specification FR-A-2201105 there is shown a device in the shape of a rod bent into a circle of a diameter of about 3 meters. The circle is placed around the golfer and is inclined a suitable angle. The circle is supported by a stand. At use the golfer places himself in the centrum of the circle which is inclined the desired angle. The golf head follows closely the circular rod and is not allowed to leave the swing plane. Such a device is certainly effective in forcing the golfer to move the club in one and the same plane. However, the device is very cumbersome and is only with great efforts movable. The device gives no indication of the target line. There is no possibility to decide which angle the swing plane should form with the ground for different types of clubs, in short it is rather inflexible.

In U.S. Pat. No. 3,942,802 there is shown a much smaller training device, which aims in correcting a defective outside-in swing. The device comprises a straight elongated rod extending roughly parallel to the target line but inclined upwards and to the right. The rod starts adjacent the ball and extends towards the target. The object is to give the golfer a vision of an inside-out swing at the moment of impact. If the swing is outside-in, the club head will hit the rod.

In U.S. Pat. No. 3,375,010 there is shown another swing training device comprising a rod, which is bent in a shallow vertical V-shape. The rod is supported above the ball and the rod forces the club head to move deeper both immediately before and after impacting the ball.

The two last-mentioned patent specifications focus the interest to the moment of impacting the ball. However, scientists claim that human muscle-to-brain-and-back-to-muscle reactions are too slow for the golfer to be able to consciously control his entire swing. Thus, most of the swing is controlled purely reflexively, and the above-mentioned two devices do only serve to show that a defective swing has been carried out, but is no positive help to obtain an efficient swing. The device according to the first-mentioned French patent specification may advantageously be used to train such reflexes.

The present invention starts from the standpoint that the last part of the swing is controlled by reflexes. Thus, a perfect swing can only be obtained if the start of the swing is perfect, while a defectively started swing must be corrected by reflexes, which do not give a repetitive result. However, the start of the swing may be controlled consciously by the golfer.

The object of the present invention is to provide a device which helps the golfer to obtain a carefully controlled swing start.

Another object of the invention is to provide a device, which indicates the correct swing plane to use, i.e. the angle between the swing plane and the ground.

These objects are obtained by a swing starter comprising a curved rod intended to indicate a desired swing plane for swinging a golf club. According to the invention, the curved rod extends from a golf ball position and backwards and upwards essentially along a portion of a circle corresponding to a desired swing circle. Moreover, the swing starter comprises an indicator means indicating when the rod has been inclined in relation to a target line for defining, together with the target line, a plane which corresponds to the desired swing plane. The curved rod indicates the bottom portion of the desired swing circle, i.e. the start of the swing, hence the name thereof.

Preferably, the swing starter comprises a straight target rod positioned close to the ground and having one pin adjacent one end thereof for engagement with the ground and connected to the target rod by a frictional connection, whereby the swing starter is pivotable under friction around an axis alined with the target rod. The target rod is connected to the curved rod by a web and the curved rod has a width which hides the remaining portion of the swing starter.

The indicator means may be a convex mirror positioned in the front portion of the curved rod and having an indicator line parallel with the target line. Alternatively, the indicator means may be a portion of the swing starter below the curved rod which becomes visible beyond the curved rod when the desired swing plane has been obtained.

The invention also relates to a method of adjusting the swing starter, in that the golfer places himself opposite the front portion of the curved rod carefully along a line which is square to the target line and at a distance beside the swing starter which corresponds to the selected club length. Finally the inclination of the rod around an axis parallel to the target line is adjusted until the indicator means indicates that the desired inclination has been obtained.

Further objects and features of the invention will become apparent from the detailed description below of a preferred embodiment of the invention by reference to the appended drawings.

Figures 1, 2:
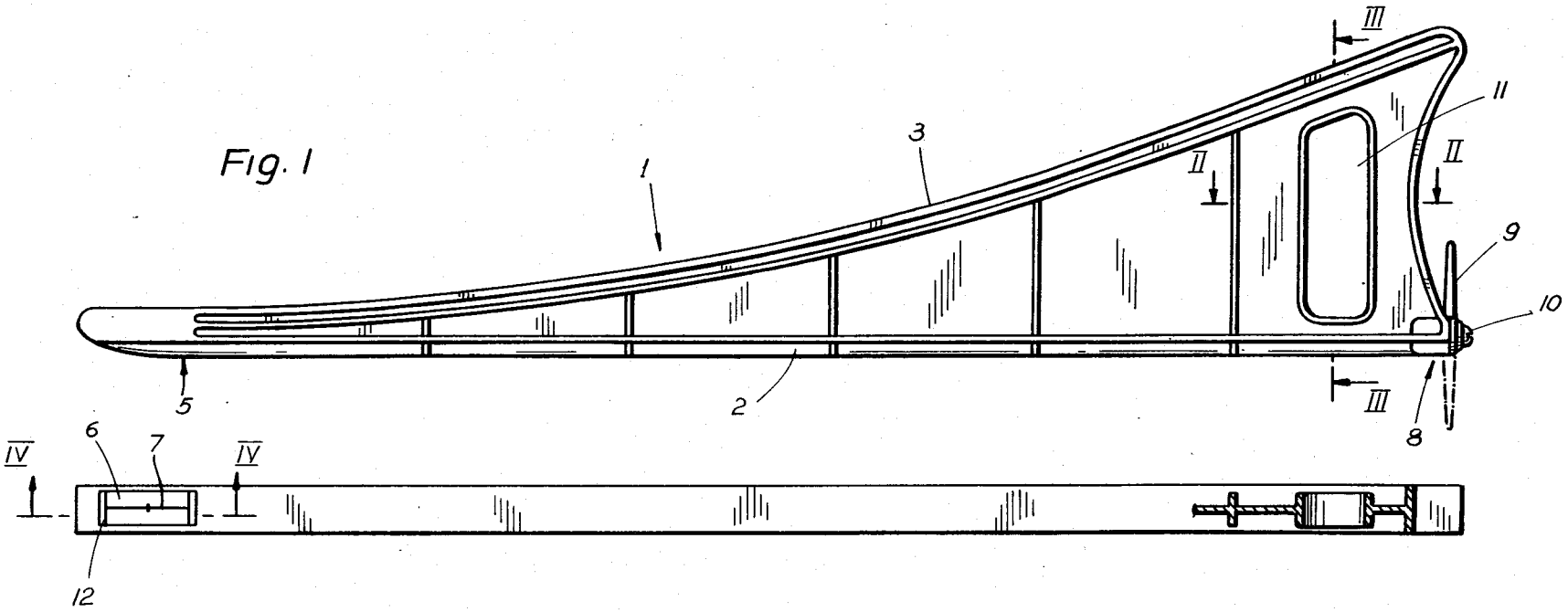
FIG. 1 is a side view of a swing starter according to the invention.
FIG. 2 is a plan view partially in section of the swing starter according to FIG. 1.
Figure 3:
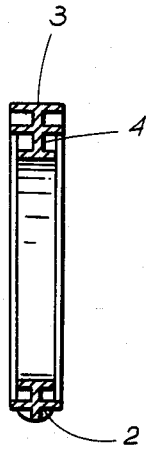
FIG. 3 is a cross-sectional view according to line III—III of FIG. 1.

In FIG. 1 there is shown the swing starter according to the present invention in a side view. The swing starter 1 according to FIG. 1 comprises a straight target rod 2 and a curved rod 3, which are joined by a web 4. The rods 2 and 3 converge in an apex portion 5. The curved rod 3 is partially circular in side view and has a radius of curvature of about 1.55 m and is about 0.6 meter long. The upper surface of the curved rod 3 is preferably plane as shown in FIG. 3 and is painted red.

Figure 4:
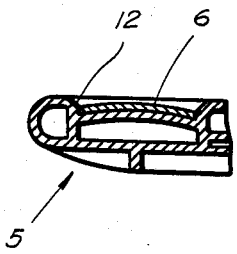
FIG. 4 is a longitudinal sectional view according to line IV—IV of FIG. 2.

The front portion or apex portion 5 is provided with a convex mirror 6 as shown in more details in FIG. 4. The mirror comprises a line 7 at its front surface, which is parallel to the target rod 2.

In the back portion 8 of the target rod, i.e. to the right in FIG. 1, a pin 9 is attached by means of a friction connection 10. The pin 9 is pivotable as shown in FIG. 1.

The swing starter is used according to the following description. First of all, the pin 9 is pivoted downwards and pierced down in the ground. The apex portion 5 is placed in the desired direction, so that the target rod extends towards the target. The rod 2 may advantageously be used as a target line. Then, the golfer places himself beside the swing starter opposite the front portion 5 and at a line extending from the front portion 5 and square to the target line. The swing starter is inclined towards the golfer, so that he can only see the red upper surface of the curved rod 3, the remaining portions of the swing starter being hidden behind the curved rod 3. The golfer may control his (or her) position in the mirror 6 and the line 7 thereon should pass through the eyes of the golfer. The golfer may also control his position if he is square to the target line by controlling if his eyes are placed on the middle of the line 7. The swing starter has now reached a position where the plane of the swing starter passes through the eyes of the golfer. However, such a plane is a little bit too vertical to be the proper swing plane which ordinary is considered being the plane passing through the shoulder portion of the golfer.

In order to indicate the right swing plane, the swing starter is further inclined about 5 to 8 degrees downwards. In this position the golfer views his shoulder portion in the mirror on the line 7 thereof and he may also see at the right end of the swing starter, a portion of the target rod 2 beyond the curved rod 3. Now the swing starter define the correct swing plane.

Finally, the club head is placed above the mirror and is moved backwards, while the club head closely follows the circular path defined by the curved rod. In this way, the club, hands, arms and shoulder will be moved as a single unit around the fixed axis of the spine and a sense of "oneness" is obtained. At the upper end position of the club head, its position may be controlled in the mirror and should be visible on the line 7.

Finally the club is moved back and should follow the swing starter closely above the surface of the curved rod 3.

By training the swing start by this training device a clear sense of the correct swing plane may be obtained and the importance of a correct swing start is emphasized.

When the correct feeling has been obtained, a golf ball is placed some centimeters before the mirror and the golfer moves himself the same distance backwards and performs a complete golf swing carefully following the swing starter beside it.

By the present training device it is possible to accurately determine the correct inclination angle of the swing plane. Moreover, it is possible to closely and carefully monitor the start of the swing.

The drawings show further constructional details. The web is provided with a through opening 11, which forms a hand grip for the swing starter. The target rod 2 and the curved rod 3 have the cross-sections shown in FIG. 3 in order to enhance the stability thereof. The web 4 and the target rod 2 are painted white, while the upper surface of the curved rod 3 is painted red in order to contrast to the green grass and so that a clear indication will be achieved of the position in which the curved rod 3 hides the remaining portion of the swing starter.

As shown in FIG. 4, the mirror 6 is positioned in a recess 12 in the front portion 5 and may have a radius of curvature of about 100 mm in the longitudinal section.

It may be observed that the radius of curvature of the curved rod 3 is about 1.55 m, which corresponds to the distance from the shoulder to the golf club head of an ordinary golfer. This distance may vary considerably from person to person and in dependence of which golf club length is used. However, the difference in the swing circle along the length of the swing starter for a swing circle of about 1.3 meter is only about 2 cm compared to a swing circle of about 1.55 meter, and this small difference may be neglected, especially since the difference is in the radial direction which is hardly visible to the golfer.

Figure 5:
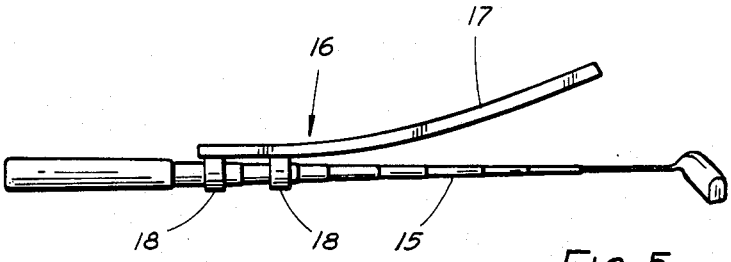
FIG. 5 is a side view of an alternative embodiment of the invention.

There are numerous amendments, which may be made to the swing starter which are within the scoope of the present invention. A second embodiment of the swing starter is shown in side view in FIG. 5. The target rod is replaced by a golf club shaft 15, which is positioned in the grass and extends towards the target. The swing starter 16 comprises a curved rod 17, which at the front portion is provided with snap fasteners 18 for connection to the club shaft, thus obtaining a frictional grip. The curved rod may be provided with a mirror at the front portion, or the alternative indicator means described above may be used. It is also possible to add a flange which becomes barely visible at the correct inclination angle.

There are further alternatives for the indicator means. It is of course not necessary first to adjust the swing starter to a plane passing through the golfers eyes and then increase the angle (relative to the vertical) by 5 to 8 degrees, but the swing starter may be directly adjustable to the correct swing plane. This may be obtained by inclining the mirror 5 to 8 degrees in relation to the surface of the curved rod so that the correct swing plane is obtained when the line 7 of the mirror passes the eyes of the golfer. Furthermore, it is possible to use two offset lines, one for the eyeplane and one for the shoulder plane, in which case the mirror is convex also in the transversely direction. There are other indicator means than the mirror, such as optical devices producing a moiré effect when the golfer views the device square to the surface thereof. Moreover, the target rod may be narrowing at the right end and at the side facing away from the golfer in order to allow the swing starter to be inclined 5 to 8 degrees until it becomes visible behind the curved rod. Alternatively the curved rod may be widening at the right end. The target rod may comprise a scale or indication lines showing the exact number of degrees of inclination relative to the eyeplane. Further modifications are feasable to a skilled person.

It is clear that the swing starter is intended to be used outdoors by piercing the pin 9 in the ground. However, the swing starter may also be used indoors by placing the pin 9 essentially horisontally pointing towards the golfer whereby the pin acts as a support for the swing starter.

The swing starter may be used as a putting trainer by placing the tip of the club head against the side of the curved rod and allowing the putter to follow the curved rod back and forwards. For this reason, the curved rod is provided with a recess at the side as appears from FIG. 3.

It is possible to make the whole swing starter in a transparent material. In this case, the swing starter may be an integral piece of transparent plastic about 10 mm thick and having the roughly triangular shape shown. The upper edge may be painted red and the lower edge may be painted white to show the swing circle and target line, respectively.

In the embodiment shown in FIGS. 1 to 4, the curved rod 3 and the target rod 2 may very well have a cross-section.

The indicator means may be a protrusion extending towards the golfer and two painted lines one at each side of the protrusion. When the same amount of lines are visible on each side ot the protrusion, the eyeplane has been obtained. In order to adjust for 5 to 8 degrees further inclination, one of the painted lines may be narrower and the other thicker.

In the case of a mirror as indicator means, it is convenient to control the position of the shoulder portion by placing the club shaft from one shoulder to the other and checking that the club shaft is carefully parallel to the line 7 of the mirror. The line 7 is preferably provided with a small middle mark as shown in the drawings.

In a swing, the club will not always be square to the curved rod but will open a small amount. This opening of the club can be shown by cross lines on the curved rod. Alternatively, the right end of the curved rod may be somewhat chamfered.

The swing starter according to the present invention is an improvement of previously used club shafts laying on the ground and indicating the target line. Such a club shaft can only indicate the target line, while the swing starter according to the present invention gives the player the right arc within the right plane in relation to the target line.

While preferred embodiments of the invention has been described above, the intention is that the invention is not limited to these embodiments, but modifications obvious to a person skilled in the art are intended to be included within the scope of the invention as defined in the appended claims.

We claim:

1. A golf swing training device comprising:

a curved rod extending from an imaginary golf ball position and along a portion of a circle;

an adjustment means for adjusting the position of said curved rod;

a means for maintaining the curved rod in said adjusted position;

an indicator means for indicating when said curved rod has been adjusted to extend along a circle which corresponds to a desired swing circle in which a tangent of the curved rod at the imaginary golf ball position extends along a desired target line and the centrum of the swing circle is positioned substantially close to the shoulder portion of a golfer, and the curved rod extends from the imaginary golf ball position and in a direction away from the target.

2. A device according to claim 1, further comprising:

a straight target rod extending along said target line;

said curved rod being rigidly connected to said straight target rod by a web extending between said rods;

said means for maintaining the curved rod in the adjusted position being at least one pin attached to at least one end of the straight target rod and being joined thereto by a friction connection.

3. A device according to claim 2, wherein the surface of the curved rod facing the golfer is flat.

4. A device according to claim 1, wherein said indicator means is a portion of the device below the curved rod becoming barely visible when the desired swing plane has been obtained.

5. A device according to claim 2 or 4, wherein the surface of the curved rod facing the golfer having a color differing from the color of the remaining portion of the device.

6. A device according to claim 1, wherein said indicator means is a convex mirror having an indicator line, the mirror being positioned adjacent the imaginary golf ball position of the curved rod.

7. A device according to claim 6, wherein said indicator line is parallel with the target line and positioned in the centrum of the mirror.

8. A device according to claim 1, wherein the overall length of the curved rod being about 0.6 m and the radius of curvature being about 1.55 m.

9. A device according to claim 1, wherein said means for maintaining the curved rod in said adjusted position being a snap fastener for attachment to the shaft of a golf club.

10. Method of adjusting a device according to claim 1, comprising a curved rod with an adjustment means for adjusting the position thereof; a means for maintaining the curved rod in the adjusted position; and an indicator means for indicating when the curved rod has been adjusted to extend along a circle, comprising the steps of placing a golfer opposite a front end portion of the curved rod, said front end portion defining an imaginary ball position, along a line which is square to a target line and at a distance from said front end portion corresponding to the club length used; and adjusting the position of the curved rod until said indicator means indicates that a desired inclination has been obtained for defining a desired swing plane.

* * * * *